US008092623B1

(12) United States Patent
Cramer et al.

(10) Patent No.: US 8,092,623 B1
(45) Date of Patent: Jan. 10, 2012

(54) IGNITER COMPOSITION, AND RELATED METHODS AND DEVICES

(75) Inventors: Randall J. Cramer, Alexandria, VA (US); Magdy Bichay, Springfield, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 544 days.

(21) Appl. No.: 12/152,120

(22) Filed: Apr. 22, 2008

Related U.S. Application Data

(62) Division of application No. 11/345,681, filed on Jan. 31, 2006, now abandoned.

(51) Int. Cl.
*C06B 33/00* (2006.01)
*D03D 23/00* (2006.01)
*D03D 43/00* (2006.01)

(52) U.S. Cl. ..... 149/37; 149/108.2; 149/108.6; 149/109.2; 149/109.4

(58) Field of Classification Search ..... 149/37, 149/108.2, 108.6, 109.2, 109.4
See application file for complete search history.

(56) References Cited

U.S. PATENT DOCUMENTS 4,094,028 A 6/1978 Fujiyama et al.
4,205,363 A 5/1980 Boos et al.
5,372,069 A 12/1994 Hart et al.
5,372,070 A * 12/1994 Neidert et al. ..... 102/290
5,959,235 A 9/1999 Wagstaff
6,066,214 A 5/2000 Comfort
6,221,187 B1 4/2001 Knowlton et al.
6,503,350 B2 1/2003 Martin et al.
6,605,167 B1 8/2003 Bloomquist
6,749,702 B1 6/2004 Knowlton et al.
6,854,395 B2 2/2005 Katsuda
6,878,221 B1 4/2005 Mei et al.
6,986,819 B2 1/2006 Tillotson et al.
2003/0030162 A1 2/2003 Yamamoto et al.
2004/0234914 A1 * 11/2004 Hale et al. ..... 431/269
2005/0183805 A1 * 8/2005 Pile et al. ..... 149/39
2005/0189053 A1 * 9/2005 Pile et al. ..... 149/108.6
2007/0272112 A1 * 11/2007 Nielson et al. ..... 102/473
2008/0245252 A1 * 10/2008 Erickson et al. ..... 102/204

OTHER PUBLICATIONS

U.S. Appl. No. 11/345,681, filed Jan. 31, 2006, Cramer et al.

* cited by examiner

*Primary Examiner* — James McDonough

(57) ABSTRACT

An igniter composition is provided including metal fuel particles having a predetermined average diameter and metallic oxide oxidizer particles having a predetermined average diameter. The metal fuel particles are mixed substantially homogeneously with the metallic oxide oxidizer particles and, upon initiation of the igniter composition, actively participate in an exothermic reaction with the metallic oxide oxidizer particles. Also provided are methods and devices containing the igniter composition.

10 Claims, 4 Drawing Sheets

IGNITER COMPOSITION, AND RELATED METHODS AND DEVICES

The present Application is a Divisional Application of U.S. patent application Ser. No. 11/345,681 filed on Jan. 31, 2006 now abandoned.

STATEMENT REGARDING FEDERALLY SPONSORED RESEARCH OR DEVELOPMENT

The invention described herein may be manufactured and used by or for the Government of the United States of America for Governmental purposes without the payment of any royalties thereon or therefore.

FIELD OF THE INVENTION

The invention relates to igniter materials suitable for the ignition of energetic charges, such as, for example, gas generators and pyrotechnics. The invention further relates to igniter-containing devices, such as, for example, gun cartridges, rocket-assisted projectiles, rocket assemblies, pyrotechnics, air bag assemblies, and others.

BACKGROUND OF THE INVENTION

Perchlorate ions and perchlorate salts, such as, for example, sodium, potassium, and ammonium perchlorates, are known for their excellent oxidizing power. Perchlorates have been used extensively as oxidizers in rocket motor assemblies, pyrotechnics, vehicle secondary restraint systems, flares, military explosives, and other devices employing gas generating or high-energy compositions. Perchlorates are especially suited for use in igniters of such devices, e.g., as part of the ignition train for initiation of combustion of a rocket motor propellant or generation of gaseous products of a gas generant.

Perchlorates are not always completely consumed in use. Rather, the activation of devices such as rockets, pyrotechnics, and explosives often releases perchlorates into the environment as fine dusts, which can be dispersed in the wind. The release of perchlorates from these devices into the environment has sometimes resulted in contamination of surface and ground water supplies. When contacted with water, these compounds dissolve, releasing perchlorate ions. Due to high solubility, perchlorates tend to be very mobile in the environment. For example, perchlorates dissolved in the water may stay in lakes and ponds, or they may be carried long distances by streams and rivers. Perchlorates dissolved in water also may sink into the ground and eventually reach groundwater aquifers. Since perchlorates are characterized by a very high activation temperature, environmental temperatures are generally too low to activate its oxidizing potential. As a consequence, perchlorates can persist unchanged in air, soil, surface water and groundwater for prolonged periods. Further, many species of plants, including those edible to humans and animals, can absorb and accumulate perchlorates from soil.

Studies have linked perchlorates to serious health afflictions. Perchlorate salts and perchlorate ions can potentially enter the human body by inhalation of dust containing the salts, and swallowing of food and drinking water containing the perchlorates. It is believed that human consumption of perchlorates may impair thyroid function in humans, with pregnant women and developing fetuses reportedly being especially vulnerable to injury from perchlorate exposure. It also has been reported perchlorates may increase the likelihood of thyroid cancer.

Due to these health concerns, environmental and other governmental regulations are seeking to phase out perchlorates from use in various industries. Accordingly, it is highly desirable to find a perchlorate replacement that provides comparable or superior oxidizer capabilities to perchlorates, without the potential environmental and health concerns reported to be caused by perchlorates.

SUMMARY OF THE INVENTION

In accordance with the purposes of the invention as embodied and broadly described herein, a first aspect of the invention provides an igniter composition including metal fuel particles having an average diameter in a range of about 30 nm to about 200 nm, and metallic oxide oxidizer particles having an average diameter less than about 400 nm. The metal fuel particles are substantially homogeneously mixed with the metallic oxide oxidizer particles and, upon initiation of the igniter composition, are active in participating in an exothermic reaction with the metallic oxide oxidizer particles.

A second aspect of the invention provides a method of initiating a charge. The method includes providing a device loaded with a charge and an igniter composition, the igniter composition including metal fuel particles having an average diameter in a range of about 30 nm to about 200 nm, and metallic oxide oxidizer particles having an average diameter less than about 400 nm. The metal fuel particles are substantially homogeneously mixed with the metallic oxide oxidizer particles and, upon initiation of the igniter composition, are active in participating in an exothermic reaction with the metallic oxide oxidizer particles. The igniter is in operative association with the charge to effect ignition of the charge. In an embodiment of this aspect, the charge includes a gas generant. In another embodiment of this aspect, the charge includes a pyrotechnic.

According to a third aspect of the invention, an impulse cartridge is provided. The impulse cartridge includes a body having a chamber, an energetic output charge housed in the chamber, an ignition charge, and an initiator for activating the igniter charge. The ignition charge in operative association with the energetic output charge for activating the energetic output charge and establishing a shock wave. The ignition charge contains metal fuel particles having an average diameter in a range of about 30 nm to about 200 nm, and metallic oxide oxidizer particles having an average diameter less than about 400 nm. The metal fuel particles are substantially homogeneously mixed with the metallic oxide oxidizer particles and, upon initiation of the ignition charge, are active in participating in an exothermic reaction with the metallic oxide oxidizer particles.

A gun cartridge is provided in accordance with a fourth aspect of the invention. The gun cartridge includes a substantially cylindrical cartridge case having a forward end and an aft end, a projectile head coupled to the front end of the cylindrical cartridge case, a propellant grain loaded in cartridge case, and a primer charge in operative association with the propellant grain for activating the propellant grain. The primer charge contains metal fuel particles having an average diameter in a range of about 30 nm to about 200 nm, and metallic oxide oxidizer particles having an average diameter less than about 400 nm. The metal fuel particles are substantially homogeneously mixed with the metallic oxide oxidizer particles and, upon initiation of the primer charge, are active in participating in an exothermic reaction with the metallic oxide oxidizer particles.

According to a fifth aspect of the invention, a rocket assembly is provided including a substantially cylindrical motor case having a forward end and an aft end, a nozzle situated at the aft end of the case, a projectile head coupled to the forward end of the case, a propellant grain loaded in case, and an igniter charge in operative association with the propellant grain for activating the propellant grain. The igniter charge contains metal fuel particles having an average diameter in a range of about 30 nm to about 200 nm, and metallic oxide oxidizer particles having an average diameter less than about 400 nm. The metal fuel particles are substantially homogeneously mixed with the metallic oxide oxidizer particles and, upon initiation, are active in participating in an exothermic reaction with the metallic oxide oxidizer particles.

A sixth embodiment of the invention provides an inflatable vehicle-occupant secondary restraint system, including a housing establishing a chamber; an airbag interconnected to the housing, a gas generant contained in the housing and in operative association with the airbag for inflating the airbag, and an igniter cartridge in operative association with the gas generant for activating the gas generant. The igniter cartridge contains metal fuel particles having an average diameter in a range of about 30 nm to about 200 nm, and metallic oxide oxidizer particles having an average diameter less than about 400 nm. The metal fuel particles are substantially homogeneously mixed with the metallic oxide oxidizer particles and, upon initiation of the igniter cartridge, are active in participating in an exothermic reaction with the metallic oxide oxidizer particles.

BRIEF DESCRIPTION OF THE DRAWINGS

The accompanying drawings are incorporated in and constitute a part of the specification. The drawings, together with the general description given above and the detailed description of particular embodiments and methods given below, serve to explain the principles of the invention. In such drawings.

DETAILED DESCRIPTION OF EXEMPLARY EMBODIMENTS AND METHODS OF THE INVENTION

Figure 1:
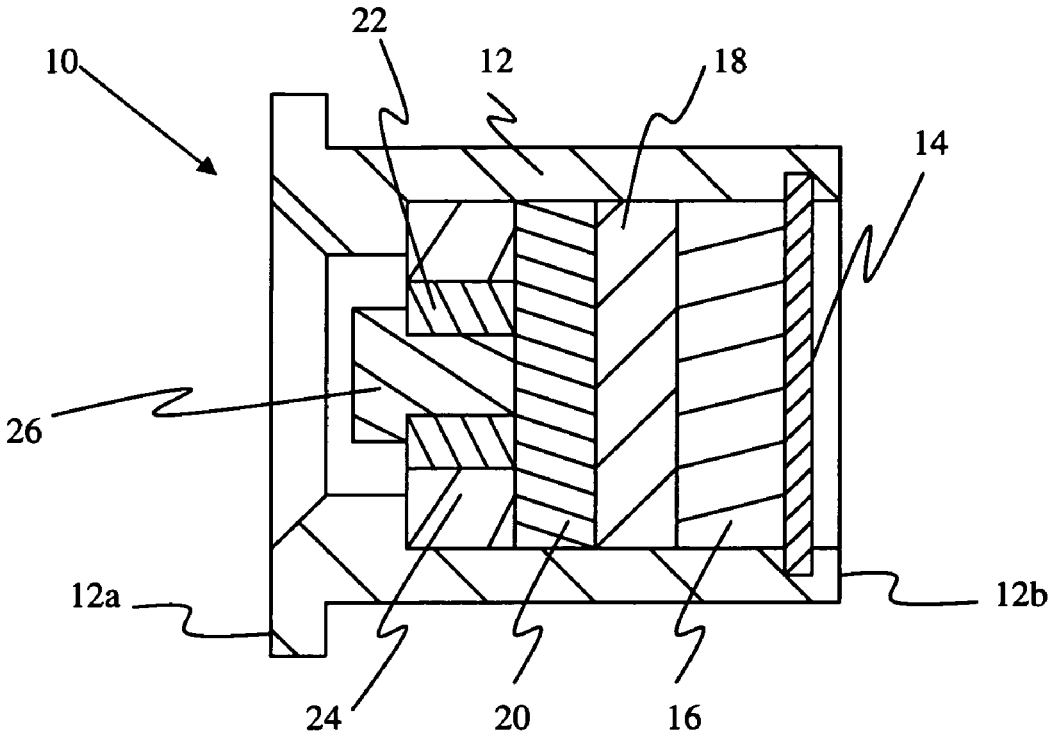
FIG. 1 is a cross-sectional schematic side view of an impulse cartridge.

Reference will now be made in detail to the exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the exemplary embodiments and methods. The invention according to its various aspects is particularly pointed out and distinctly claimed in the attached claims read in view of this specification, and appropriate equivalents.

The igniter composition according to an embodiment of the invention includes metal fuel particles, metallic oxide oxidizer particles, and optionally one or more other components, such as, for example, a binder and/or energetic compound. The metal fuel particles and metallic oxide particles of this embodiment are intermixed substantially homogeneously with one another to permit reaction therebetween. Without wishing to be bound by any theory, it is believed that the metal fuel particles and metal oxide oxidizer particles undergo an exothermic or thermite reaction with one another upon initiation of the igniter composition according to the following equation:

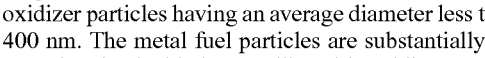

$$X+Y_nO_m \longrightarrow X_pO_q+Y,$$

wherein X is the metal fuel, Y is the metallic component of the oxidizer, and n, m, p, and q are determined by the valences of the metals and oxygen.

The metal fuel particles are primarily constituted by an active metal or metals, particularly in their cores below a particle surface layer. The metal fuel particles optionally include surface layers containing metallic oxide, e.g., aluminum oxide, such as occurring by reaction of the metallic surface with an oxygen-containing environment. Generally, the metallic oxide surface layers are inactive with respect to the oxidizer particles and, therefore, the presence of these surface layers is generally small. Generally, at least about 65 weight percent of the metal fuel particles include active metal for participating in the exothermic reaction with the metallic oxide oxidizer particles. To obtain high percentages of active metal, the metal fuel particles generally are nanoparticles having a predetermined average diameter in a range of about 30 nm to about 200 nm, and more particularly in a range of about 50 nm to about 80 nm. Particle sizes less than about 30 nm generally are not desired because the inactive metals of the oxide surface layer constitute a high percentage of the particle volume, leaving less active metal for reaction with the metallic oxide oxidizer particles. On the other hand, metal fuel particle sizes greater than about 200 nm have small surface-to-volume ratios, which can hamper reaction rate. The metal fuel particles may constitute any appropriate size or shape, such as oval or spherical configurations, although other random and nonrandom shapes may be used.

Examples of suitable metal fuel nanoparticles include aluminum, boron, hafnium, tantalum, zirconium, their alloys, and combinations thereof. An embodiment includes aluminum nanoparticles. Nanoparticles are commercially available through companies such as, for example, Nanotechnologies Inc. Alternatively, nanoparticles may be made using, for example, pulse-plasma technique or vapor deposition technique, as well as other techniques known in the art.

The metallic oxide oxidizer particles generally have a metallic oxide structure substantially throughout, i.e., the oxides are found substantially throughout the metallic oxide oxidizer particles and not only on the surface layers of the metallic oxide oxidizer particles. The metallic oxide oxidizer particles may have an average diameter less than about 400 nm, for example, in a range of about 30 nm to about 400 nm. Particle sizes greater than 400 nm have poor homogeneity of mixture with the metal fuel particles, resulting in inferior reactions. Representative metallic oxide oxidizer particles that may be selected for the purposes of this embodiment include, for example, bismuth trioxide ($Bi_2O_3$), molybdenum oxide, titanium oxide, iron oxide, tungsten oxide, copper oxide, zinc oxide, oxides of other transition metals, and combinations and alloys thereof. The metallic oxide oxidizer particles may constitute any appropriate size or shape, such as oval or spherical configurations, although other random and nonrandom shapes may be used.

The igniter composition may contain oxidizers other than metallic oxides for participating in the exothermic reaction. For example, the igniter composition may include oxidizer salts, such as ammonium nitrate, potassium nitrate, and sodium nitrate. However, the composition generally, yet optionally, is substantially free of perchlorates, with the possible exception of small amounts of perchlorate impurities. Also, the igniter composition may contain fuels other than metal fuel particles, such as carbon.

The igniter composition optionally contains additional components. For example, the igniter composition may contain an energetic compound, such as nitrates (e.g., pentaerythritol tetranitrate (e.g., PETN)) and nitramines (e.g., RDX, HMX), generally in about 5 weight percent of the total igniter composition weight. Optionally, the igniter composition also contains a small amount of binder materials, such as, less than 5 weight percent of the total igniter composition weight. The binder material may be energetic or non-energetic. Examples of binders include, without limitation, camphor, polyethyleneglycol, polyvinylalcohol, wax, oxetanes, polyglycidylnitrate, nitrocellulose, glycidyl azide polymer, and others. The binder generally is present in an amount of less than 5 weight percent, and more particularly less than 3 weight percent of the total weight of the igniter composition. Other protective agents, such as oleic acid and succinic acid may be used to protect further oxidation of the fuel component of the igniter composition. In an embodiment, the total amount of fuel in the igniter composition may exist between about 15 weight percent and about 85 weight percent. More particularly, the metal fuel particles constitute between about 15 weight percent and about 85 weight percent of the igniter composition. Similarly, in an embodiment, the total amount of oxidizer in the igniter composition may exist between about 15 weight percent and about 85 weight percent. More particularly, the metallic oxide oxidizer particles constitute between about 15 weight percent and about 85 weight percent of the igniter composition. The concentrations and selected metals and metallic oxides may be varied as desired to meet performance requirements and specifications. In an embodiment, the concentration of the mixture is between about 80 wt. %-about 85 wt. % oxidizer and between about 15 wt. %-about 20 wt. % fuel depending on the oxygen content of the fuel.

A method for making the igniter composition of the present invention will now be described in detail below. The below-described method represents an exemplary, but not the exclusive, technique for preparing the igniter composition.

According to an embodied method, the metal fuel particles and metallic oxide oxidizer particles are subjected to a dry mix operation. To improve processing, a wetting agent may be added early in the mixing operation. Exemplary wetting agents include hydrocarbons, such as hexane or heptane. Optionally, additional processing agents, such as ethanol, may be used. It also may be possible to use supercritical fluids, such as carbon dioxide. Mixing is performed using standard mix operations, although it may be beneficial to use an ultrasonic bath to facilitate mixing. The mixing operation generally is continued until the metal fuel particles and metallic oxide oxidizer particles are mixed substantially homogenously, generally, establishing a substance with a putty-like texture. The substance may be subjected to a drying operation, generally air drying. In its dried state, the substance generally retains sufficient malleability to permit shaping or packing into a desired configuration.

According to another embodiment of the invention, an igniter comprising the igniter composition of the invention is arranged in operative association with an initiator and primary charge for establishing an ignition train. Representative initiators that may be used in combination with the igniter composition include, for example, squibs, electric matches, electrodes, bridge wires, lasers, etc. Examples of primary charges include gas generants, pyrotechnics, explosives, etc.

The igniters of the present invention are suitable for use in a variety of devices, including, for example, impulse charges, gun-propelling charges, rocket motors, tactile missiles, pyrotechnics, explosives, gas generating devices, such as air bag (secondary restraint) assemblies, etc.

Referring to FIG. 1, an impulse cartridge according to an embodiment of the invention is depicted in cross-sectional side view. Impulse cartridge 10 include a substantially cylindrical body 12 having a central chamber extending between a flanged rear end 12*a* and a front end 12*b*. A closure disc 14 extends across the chamber opening at front end 12*b* to seal off the chamber. An energetic output charge 16 is adjacent to a rear surface of closure disc 14, and extends across the entire width of the chamber of body 12. Output charge 16 generally includes an energetic, such as, for example, a nitramine (e.g., HMX, RDX). Abutting the rear surface of output charge 16 is a booster charge 18, such as boron-potassium nitrate ($BKNO_3$). Further rearward is ignition charge 20. Ignition charge 20 and optionally booster charge 18 comprise the igniter composition of the present invention. An inner annular bridgewire 22 and an outer annular glass header 24 are situated adjacent a rear surface of ignition charge 20. Contact pin 26 possesses a stem portion received within bridgewire 22 so that a forward end of the stem portion either contacts or is in close proximity to ignition charge 20. Contact pin 26 further possesses an exposed head portion 24 behind bridgewire 22.

In operation, a firing pin or hammer strikes the head portion of contact pin 26, driving the stem portion of contact pin 26 into ignition charge 20. The frictional and/or impact forces that the stem portion imparts on ignition charge 20 causes charge 20 to ignite, in turn effecting detonation of booster charge 18 and, in turn, output charge 16. The shock wave created by output charge 16 may be used for various purposes, such as ejection of an aircraft seat or canopy.

Figure 2:
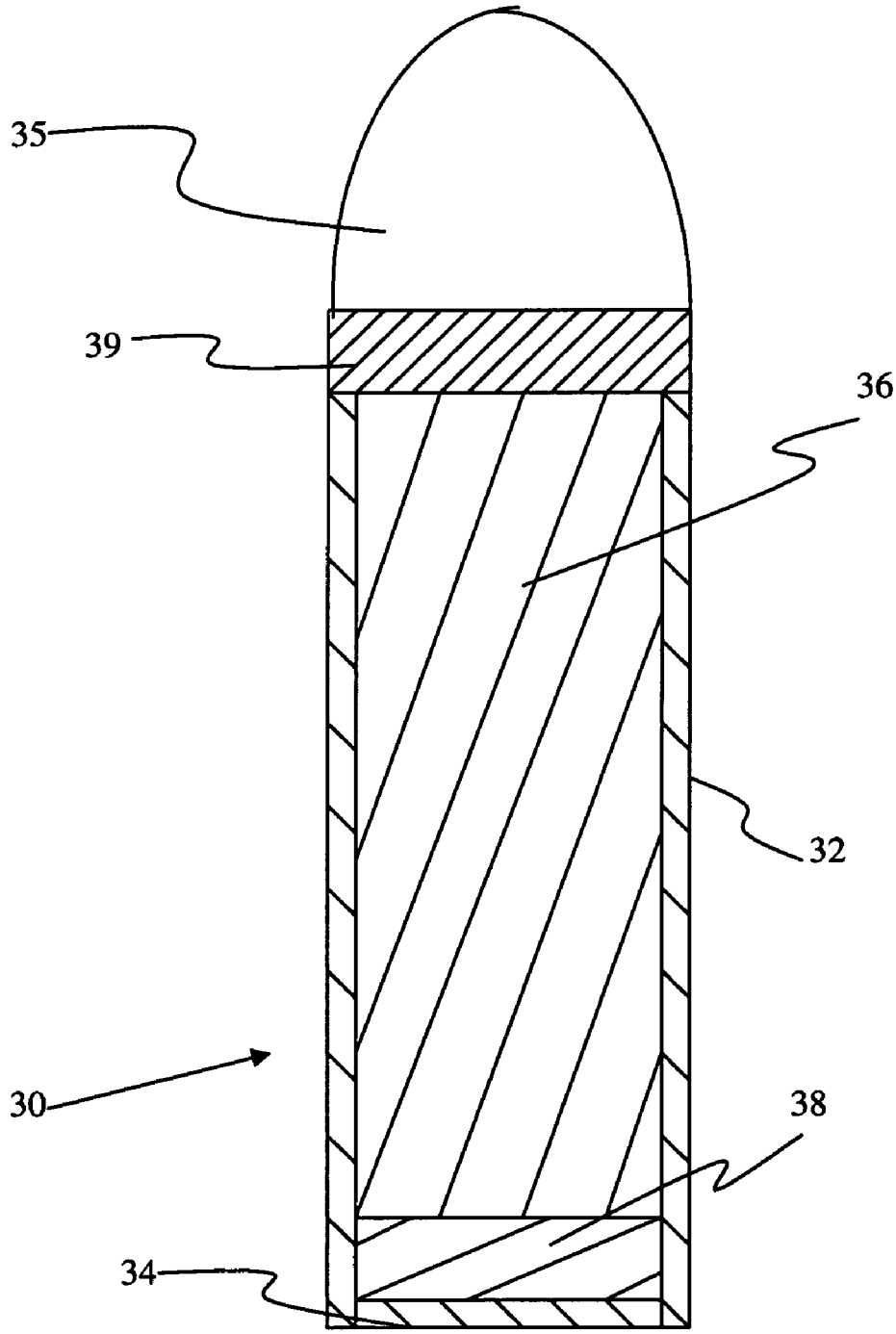
FIG. 2 is a partially sectioned, schematic side view of a gun cartridge.

FIG. 2 shows a partially sectioned schematic side view of a gun cartridge 30. A cylindrical cartridge case 32 is closed at an aft end by a first end closure 34. A second end closure 39 is located at the opposite forward end of case 32. Second end closure 39 couples case 32 to projectile head 35, which is not depicted in sectional view. Case 32 defines a chamber filled with a propellant grain 36. A percussion primer charge 38 interposed between grain 36 and first end closure 34 comprises an igniter composition as embodied above. Although shown as an end-burn propellant, it should be understood that propellant grain 36 may have a central perforation (bore), with primer located within the central perforation.

Figure 3:
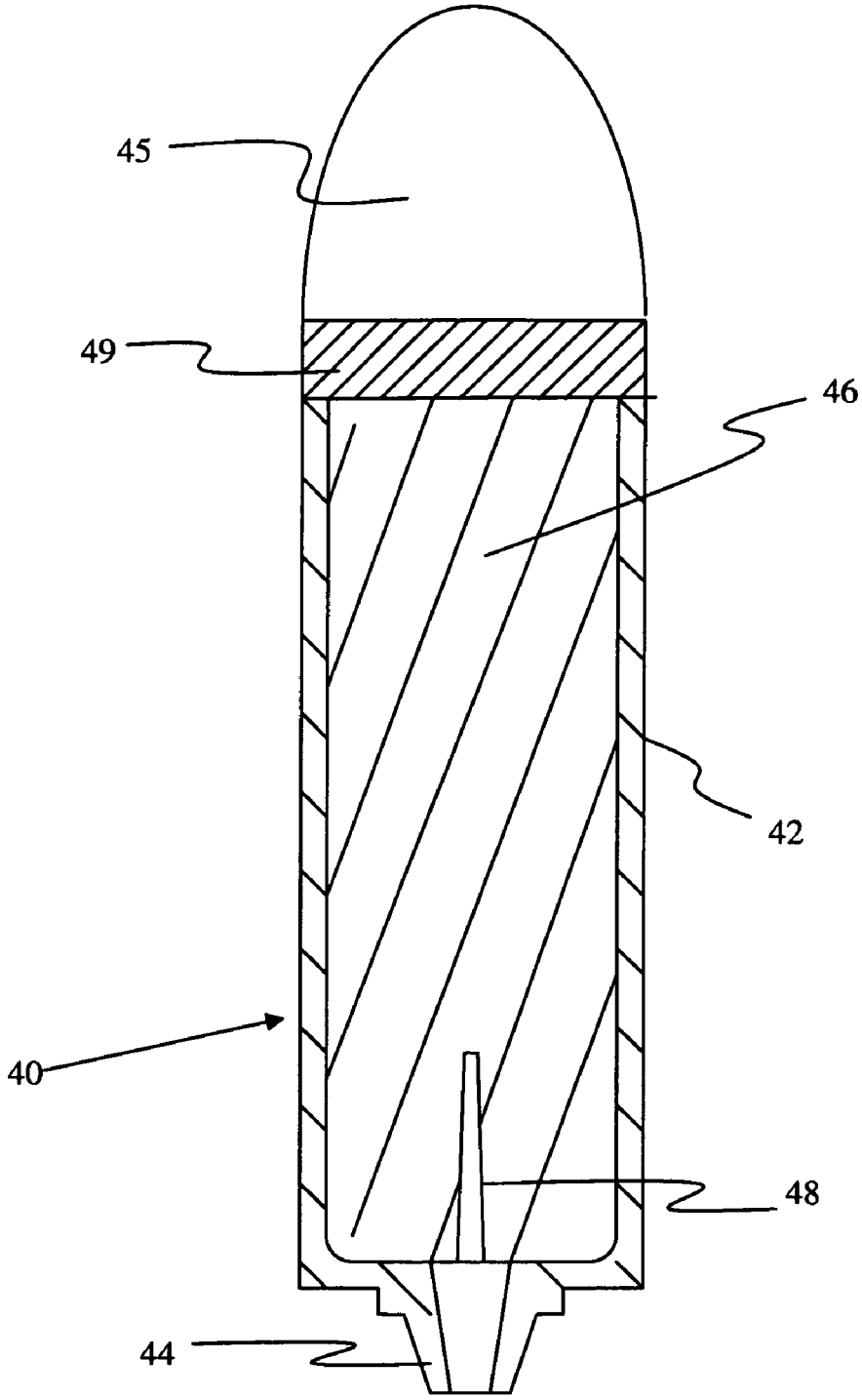
FIG. 3 is a partially sectioned schematic side view of a rocket-assisted projectile and cartridge.

A cross-sectional schematic side view of a rocket-assisted projectile and cartridge 40 according to another embodiment of the invention is depicted in FIG. 3. A cylindrical cartridge case 42 is open at an aft end to communicate with diverging nozzle 44. A forward end closure 49 couples case 42 to projectile head 45, which is not shown in sectional view. Case 42 defines a chamber loaded with a propellant grain 46. A primer 48 extends into the aft surface of propellant grain 46 centrally to align with opening of nozzle 44. Primer 48 includes an igniter composition as embodied above.

Figure 4:
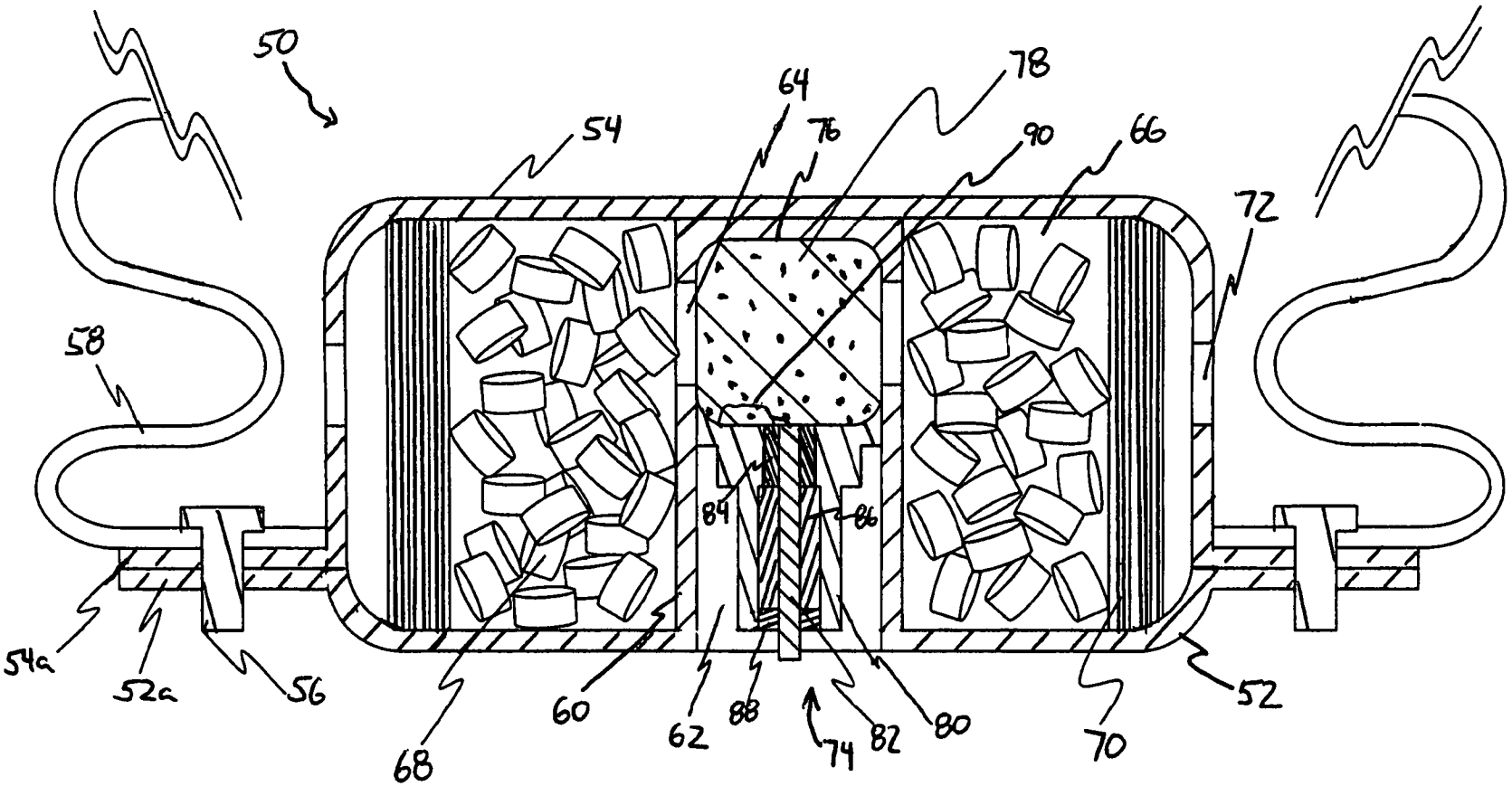
FIG. 4 is a cross-sectional schematic side view of a gas-generating airbag inflation device useful in vehicle supplemental restraint systems.

FIG. 4 is a sectional side view of an inflator or gas generating device, and more particularly an airbag deployment device suitable for a vehicle occupant restraint system. Inflator device 50 includes a generally cylindrical external shape established by a base housing member 52 and a lid housing member 54. Housing members 52 and 54 feature flanges 52*a* and 54*a*, respectively, including thread holes for receiving fasteners 56, such as bolts or screws. When placed adjacent one another, housing members 52 and 54 establish an enclosure. An inflatable folded airbag 58 situated outside of the enclosure is attached to flanges 52*a*, 54*a* via fasteners 56.

Within the enclosure, housing members 52 and 54 include internal walls 60 facing one another. An inner chamber 62 is situated between walls 60. An igniter cartridge 74 is insertable from below housing member 52 into inner chamber 62. Igniter cartridge 74 includes an igniter charge 78, which include an igniter composition embodied herein. Igniter charge 78 is surrounded by a rupturable casing 76. Igniter cartridge 74 further includes an insert body 80 connected to casing 76. The connection between casing 76 and insert body 80 may include any suitable mechanical or chemical fastener or fastening technique, such as crimping. A central electrode 82 extends through insert body 80 to contact the bottom of igniter charge 78. Central electrode 82 is surrounded by glass seal 84 and epoxy seal 88 at its opposite ends. Ferrite bead 86 is positioned between seals 84 and 88 to surround the majority of the cylindrical surface of electrode 82. Electrode 82 is operatively connected to bridgewire 90, which contacts and more preferably extends through igniter charge for initiation purposes.

Inner ports 64 communicate inner chamber 62 with an outer chamber 66, in which a gas generant 68 and filters 70 are situated. As illustrated in FIG. 4, gas generant 68 includes a plurality of pellets, although other generant structures known in the art may be selected. Sufficient gas generant 68 is placed in outer chamber 66 to permit full inflation of airbag 58. Gas flow outlet ports 72 communicate outer chamber 66 with the inside of airbag 58 to permit generated gases egressing from outer chamber 66 and fully inflate airbag 58.

In operation, in the event of a vehicle accident a sensor sends a signal to electrode 82 for activation. Electrode 82 causes bridgewire 90 to heat and effect ignition of igniter composition 78, which results in an increase in pressure within inner chamber 62 and rupturing of casing 76. Ignition products produced by igniter composition 78 egress through inner ports 64 into outer chamber 66 containing gas generant 68. The ignition products come into contact with gas generant 68 and cause gas generant 68 to undergo combustion. Combustion gases released from gas generant 68 pass through gas flow outlet ports 72 to inflate and unfold airbag 58. As airbag 58 expands, it generally will rupture through a vehicle interior structure, such as a steering wheel cover or dashboard, to cushion the vehicle occupant (driver or passenger) in the event of an accident.

Additional advantages and modifications will readily occur to those skilled in the art having reference to this disclosure. Therefore, the invention in its broader aspects is not limited to the specific details, representative devices and methods, and illustrative examples shown and described. Accordingly, departures may be made from such details without departing from the spirit or scope of the general inventive concept as defined by the appended claims and their equivalents.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An igniter composition, comprising:

metal fuel particles including an average diameter in a range of about 30 nm to about 200 nm; and metallic oxide oxidizer particles including an average diameter less than about 400 nm, the metal fuel particles are mixed substantially homogeneously with the metallic oxide oxidizer particles and, upon initiation of the igniter composition, which it substantially free of perchlorates, the metal fuel particles actively participate in an exothermic reaction with the metallic oxide oxidizer particles.

2. The igniter composition of claim 1, wherein the metal fuel particles are selected from at least one of aluminum, boron, hafnium, tantalum, zirconium, and alloys thereof.

3. The igniter composition of claim 1, wherein the metal fuel particles are comprised of aluminum.

4. The igniter composition of claim 1, wherein the average diameter of the metal fuel particles is in a predetermined range of about 50 nm to about 80 nm.

5. The igniter composition of claim 1, wherein the metallic oxide oxidizer particles are selected from at least one of bismuth oxide, molybdenum oxide, titanium oxide, iron oxide, tungsten oxide, copper oxide, zinc oxide and alloys thereof.

6. The igniter composition of claim 1, wherein the metallic oxide oxidizer particles is comprised of bismuth oxide.

7. The igniter composition of claim 1, wherein the metal fuel particles are comprised of aluminum, and wherein the metallic oxide oxidizer particles are comprised of bismuth oxide.

8. The igniter composition of claim 1, wherein the metal fuel particles are about 15 to about 85 weight percent of the igniter composition, and wherein the metallic oxide oxidizer particles are about 85 to about 15 weight percent of the igniter composition.

9. The igniter composition of claim 1, further comprising a binder.

10. The igniter composition of claim 1, wherein the igniter composition is free of perchlorates.

* * * * *